US010888110B2

(12) United States Patent
Mueller et al.

(10) Patent No.: US 10,888,110 B2
(45) Date of Patent: Jan. 12, 2021

(54) MODULAR MACHINE FOR PROCESSING AND/OR TESTING ROD-SHAPED ARTICLES, AND RELATED METHODS

(71) Applicant: Hauni Maschinenbau GmbH, Hamburg (DE)

(72) Inventors: Peter Mueller, Richmond, VA (US); Falk Abel, Richmond, VA (US); Wilfried Hoffmann, Locust Hill, VA (US)

(73) Assignee: HAUNI MASCHINENBAU GMBH, Hamburg (DE)

( * ) Notice: Subject to any disclaimer, the term of this patent is extended or adjusted under 35 U.S.C. 154(b) by 687 days.

(21) Appl. No.: 14/095,103

(22) Filed: Dec. 3, 2013

(65) Prior Publication Data

US 2014/0261477 A1 Sep. 18, 2014

Related U.S. Application Data

(60) Provisional application No. 61/962,288, filed on Mar. 15, 2013.

(51) Int. Cl.
*A24C 5/34* (2006.01)
*A24C 5/14* (2006.01)
(Continued)

(52) U.S. Cl.
CPC ..... *A24C 5/34* (2013.01); *A24C 5/00* (2013.01); *A24C 5/14* (2013.01); *A24C 5/52* (2013.01);
(Continued)

(58) Field of Classification Search
CPC ..... A24C 3/00
See application file for complete search history.

(56) References Cited

U.S. PATENT DOCUMENTS 1,952,559 A * 3/1934 Miller ..... A24C 5/18 131/60
2,103,721 A * 12/1937 Herrmann ..... A24C 5/1807 131/66.1
(Continued)

FOREIGN PATENT DOCUMENTS

CN 1256098 A 6/2000
CN 1541575 A 11/2004
(Continued)

OTHER PUBLICATIONS

Mechanical Magic, Hauni's Merlin Filter Assemblier Delivers Utlimate Flexibility; Tobacco Reporter Apr. 2004 (Year: 2004).*
(Continued)

*Primary Examiner* — Joseph S Del Sole
*Assistant Examiner* — Manley L Cummins, IV
(74) *Attorney, Agent, or Firm* — Venable LLP; Michele V. Frank

(57) ABSTRACT

A processing machine for rod-shaped articles includes a base frame including a back plate extending upward from the base frame; and a plurality of function modules each adapted to perform a manufacturing function on a rod-shaped article. Each function module includes a mounting plate adapted to removably attach the function module to the back plate as a unit, and a dedicated drive motor supported on the mounting plate and adapted to move at least a portion of the function module. The plurality of function modules includes at least one of a rod infeed module, a hopper module, a drum module, a knife module, and a gluing module. A method of configuring a modular processing machine for rod-shaped articles is also described.

14 Claims, 8 Drawing Sheets

(51) Int. Cl.
*A24C 5/00* (2020.01)
*A24C 5/52* (2006.01)

(52) U.S. Cl.
CPC .... *Y10T 29/49778* (2015.01); *Y10T 29/49826* (2015.01)

(56) References Cited

U.S. PATENT DOCUMENTS 4,149,681 A * 4/1979 Schluter ..... A24C 5/20 242/575
4,237,907 A 12/1980 Pawelko et al.
4,463,766 A * 8/1984 Arthur ..... H02P 5/56 131/280
4,886,077 A 12/1989 Hinzmann et al.
5,012,825 A 5/1991 Lindemann et al.
5,383,988 A * 1/1995 Herrmann ..... A61F 13/15804 156/297
5,634,477 A * 6/1997 Ogura ..... A24C 5/31 131/35
6,273,165 B1 * 8/2001 Gundersen ..... A61F 13/15804 156/367
6,325,068 B1 * 12/2001 Dombek ..... A24C 5/007 131/280
8,464,724 B2 * 6/2013 Balletti ..... A24D 3/0287 131/88
2002/0174873 A1 * 11/2002 Schlisio ..... A24C 5/478 131/282
2004/0060653 A1 4/2004 Hebels et al.
2004/0118418 A1 6/2004 Hancock et al.
2004/0200486 A1 10/2004 Schlisio et al.
2004/0216754 A1 * 11/2004 Rizzoli ..... A24C 5/00 131/280
2005/0022830 A1 * 2/2005 Dombek ..... A24C 5/327 131/76
2005/0139452 A1 * 6/2005 Folger ..... A24C 5/327 198/468.4
2005/0172977 A1 * 8/2005 Jadot ..... A24C 5/005 131/365
2006/0201523 A1 * 9/2006 Schlisio ..... A24C 5/475 131/94
2010/0012135 A1 * 1/2010 Balletti ..... A24C 5/327 131/88
2014/0158142 A1 * 6/2014 Le Roux ..... A24C 5/471 131/58

FOREIGN PATENT DOCUMENTS

CN 201691046 U 1/2011
DE 2842834 A1 4/1980
DE 19856934 A1 6/2000
EP 0589859 A1 3/1994
EP 0762863 B1 9/1999
EP 1472937 A2 11/2004
EP 2 145 551 A2 1/2010
WO 95/32694 A1 12/1995
WO 2005/048747 A1 6/2005
WO 2012/164067 A2 12/2012

OTHER PUBLICATIONS

Hauni, TIP for protos: OTIS—Optical Tipped Cigarette Inspection system, (2012) https://www.hauni.com/index.php?RDCT=37a208222d4d4709d059, retrieved Jan. 11, 2019 (Year: 2012).*
Taco Tunistra, Mechanical Magic, Tobacco Reporter, Apr. 2004, pp. 2, 3, 6, 50, 51.
Lab Max: Compact, versatile R & D filter assembler, Hauni Richmond, 1998.
Pilot Maker: Compact, versatile R & D maker, Hauni Richmond, 1998.
Notice of Opposition in European Patent Application No. 14158208.0 dated Jul. 10, 2018.
Office Action in Chinese Patent Application No. 201410094377.8 dated Sep. 5, 2016.

* cited by examiner

MODULAR MACHINE FOR PROCESSING AND/OR TESTING ROD-SHAPED ARTICLES, AND RELATED METHODS

CROSS-REFERENCE TO RELATED APPLICATIONS

This application claims priority under 35 U.S.C. Section 119 of U.S. Provisional Application No. 61/962,288, filed on Mar. 15, 2013, the entire content of which is incorporated herein by reference.

TECHNICAL FIELD

This patent application relates generally to equipment and methods for processing and/or testing products, such as rod-shaped products. More specifically, this patent application relates to modular equipment for processing and/or testing tobacco products, such as cigarettes and the like, and related methods.

BACKGROUND

Cigarette processing equipment typically needs to be adjustable in order to accommodate brand changes, format changes, and the like. Furthermore, it is beneficial for cigarette manufacturing equipment to provide a variety of different functionalities, such as providing testing capabilities in addition to assembly or processing capabilities. These concerns may be particularly important for small-batch manufacturers, who typically run multiple small batches of different formats, yet have limited resources to purchase multiple pieces of equipment. Existing cigarette processing equipment provides the adjustment capability for brand changes, format changes, and to vary functionalities. However, these adjustments are typically cumbersome, time consuming, and/or necessitate significant recalibration.

SUMMARY

According to an embodiment, a processing machine for rod-shaped articles comprises a base frame including a back plate extending upward from the base frame; and a plurality of function modules each adapted to perform a manufacturing function on a rod-shaped article, each function module including a mounting plate adapted to removably attach the function module to the back plate as a unit, and a dedicated drive motor supported on the mounting plate and adapted to move at least a portion of the function module; wherein the plurality of function modules includes at least one of a rod infeed module, a filter hopper module, a drum module, a tipping knife module, and a gluing module.

According to another embodiment, this application relates to a method of configuring a modular processing machine having a base frame including a back plate extending upward from the base frame, the method comprising attaching a function module to the back plate as a unit, the function module adapted to perform a manufacturing function, wherein the function module includes a dedicated drive motor adapted to drive at least a portion of the function module; wherein the function module is at least one of a rod infeed module, a filter hopper module, a drum module, a tipping knife module, and a gluing module.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

In FIG. 7, only the inspection module, gluing module, tipping module, and bobbin changeover module are shown for clarity.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

Figure 1:
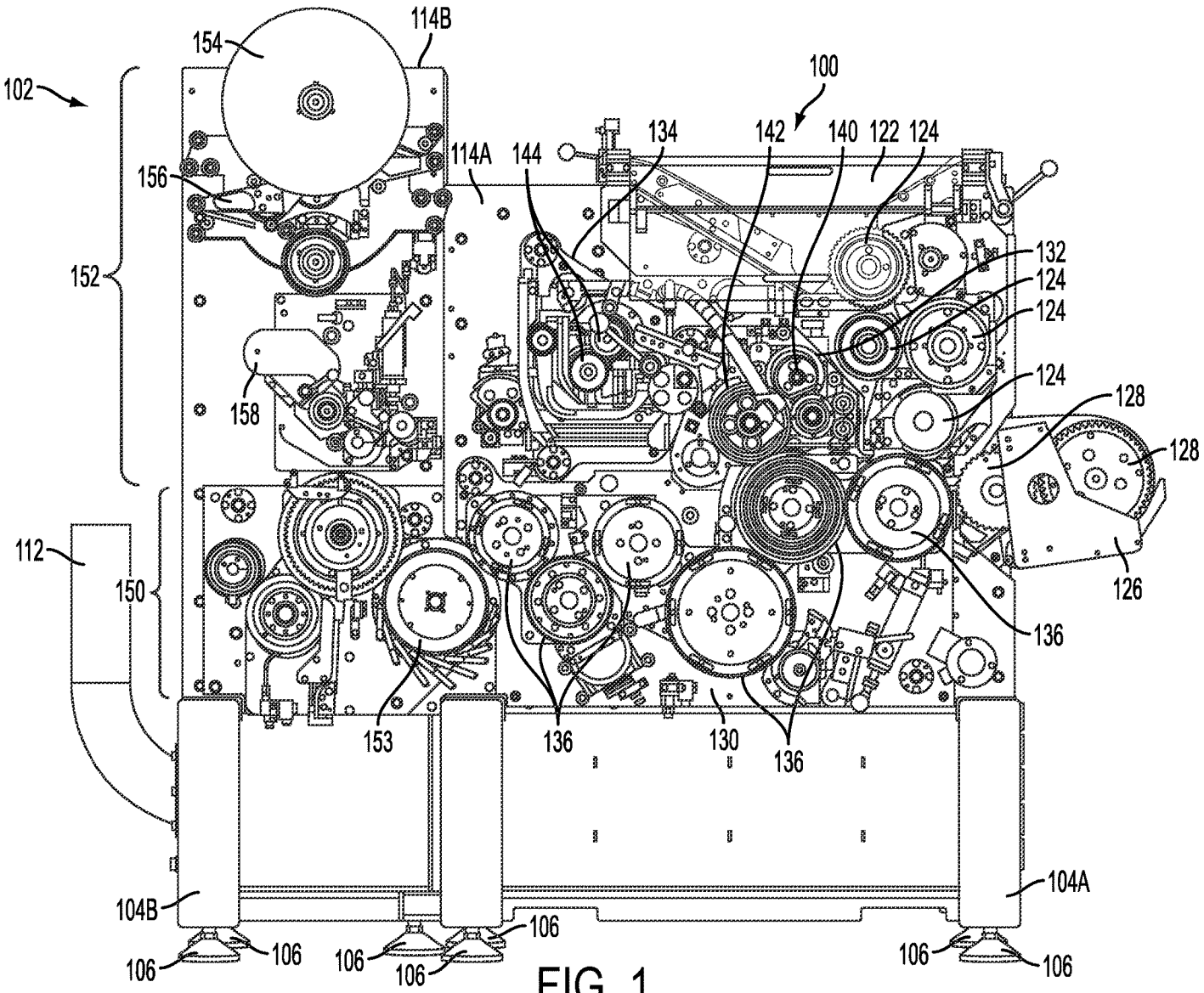
FIG. 1 is a front view of an embodiment of a modular cigarette processing and inspection machine.

Referring to FIG. 1, this application relates to a processing and/or inspection machine. While the machine can be used with tobacco and non-tobacco products alike, for sake of description, it will be described herein in the context of a cigarette processing machine 100, as well as a cigarette inspection machine 102. The cigarette processing machine 100 and cigarette inspection machine 102 can be used together, as shown in FIG. 1, or alternatively, can be used as separate stand-alone units.

According to embodiments, the processing machine 100 and/or the inspection machine 102 can be modular in configuration, meaning they comprise a plurality of different function modules that can be added or removed as functioning subunits with little or no assembly or disassembly. This type of "plug-and-play" modularity can allow the machines to perform a variety of functions typically performed by multiple machines, and/or can accommodate a variety of different product formats, without requiring significant down time and labor costs to reconfigure and recalibrate the machines for different operations or product formats. This may be particularly advantageous for smaller cigarette manufacturers who lack the capital required to invest in multiple cigarette manufacturing and/or inspecting machines.

Figure 2:
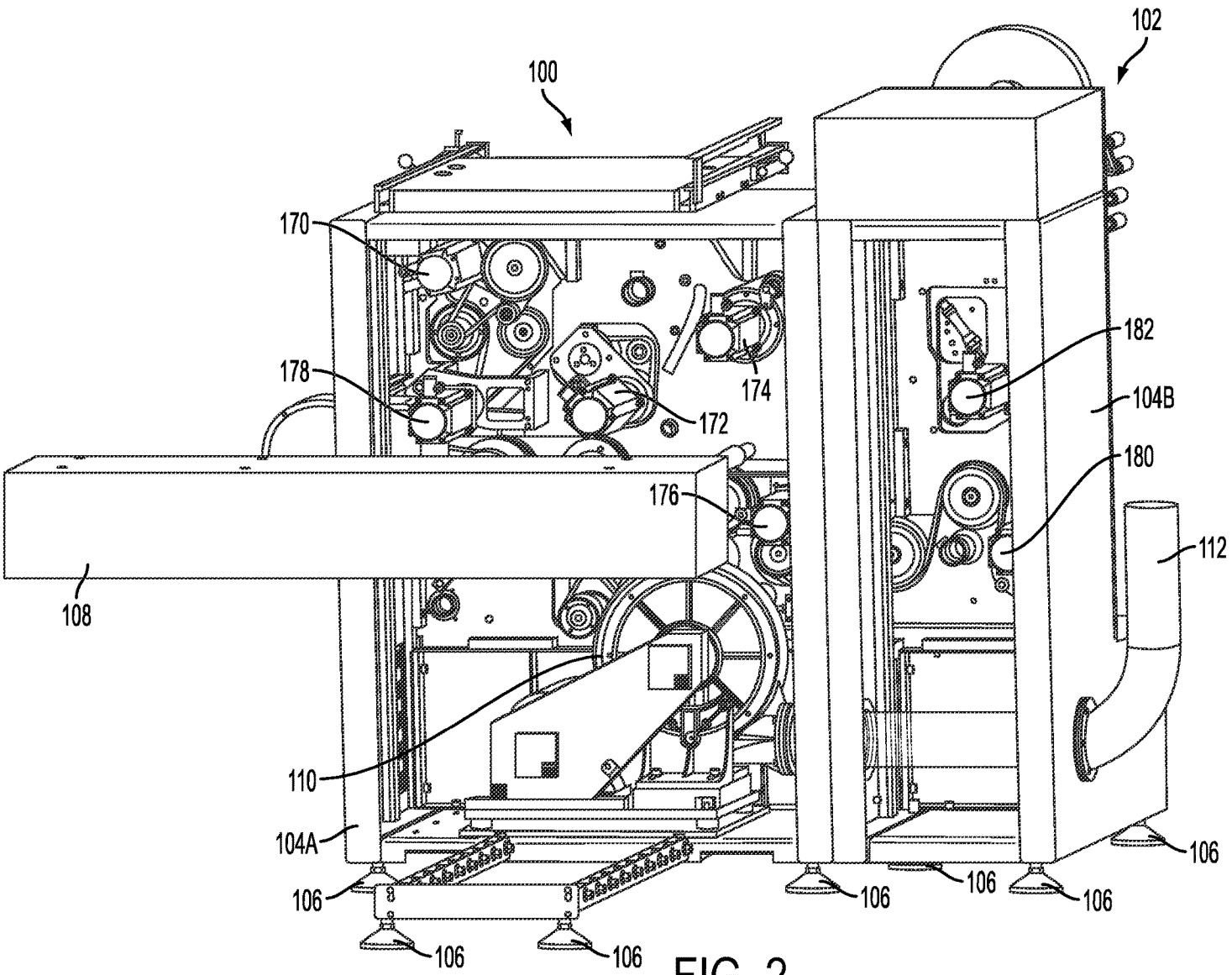
FIG. 2 is a rear, perspective view of the modular cigarette processing and inspection machine of FIG. 1.

Referring to FIGS. 1 and 2, the cigarette processing machine 100 and cigarette inspection machine 102 (hereinafter "machines 100, 102" for ease of discussion) can comprise a base frame that forms the foundation of the machines 100, 102. As shown in FIGS. 1 and 2, the base frame can include a first portion 104A for the cigarette processing machine 100, and a second portion 104B for the cigarette inspection machine 102. As will be discussed in more detail below, these portions 104A, 104B can comprise separate, self-supporting units connected together. However, alternative embodiments can include a single, integral base frame for both machines 100, 102. According to embodiments, the base frame portions 104A, 104B can have a maximum height (e.g., as measured from the floor) of between about 1,500 mm and 1,600 mm, however, other dimensions are possible. According to embodiments including a turntable 154 and bobbin 156, the overall height of the machine may be higher, for example, on the order of about 2,000 mm to 2,200 mm.

Still referring to FIGS. 1 and 2, the base frames 104A, 104B can include a plurality of feet 106 that support the base frames 104A, 104B. The base frames 104A, 104B can also house a variety of electronic components, which may be required to operate the machines 100, 102. For example, the electrical and/or electronic components can be located in a cabinet that is attached to the base frame 104A, 104B, or is a separate detached unit.

Figure 3:
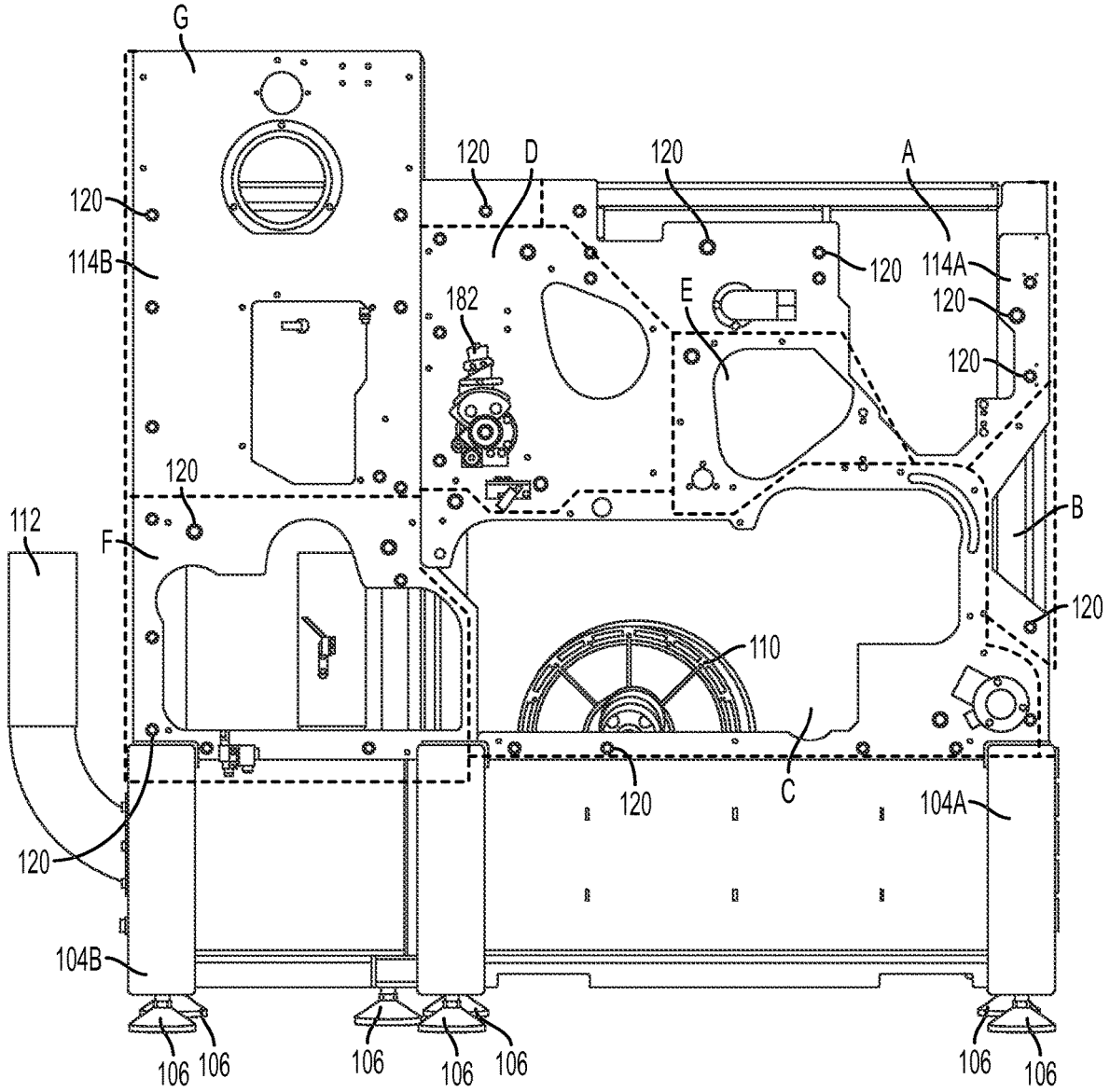
FIG. 3 is a front view of a base frame of the modular cigarette processing and inspection machine of FIG. 1.
Figure 4:
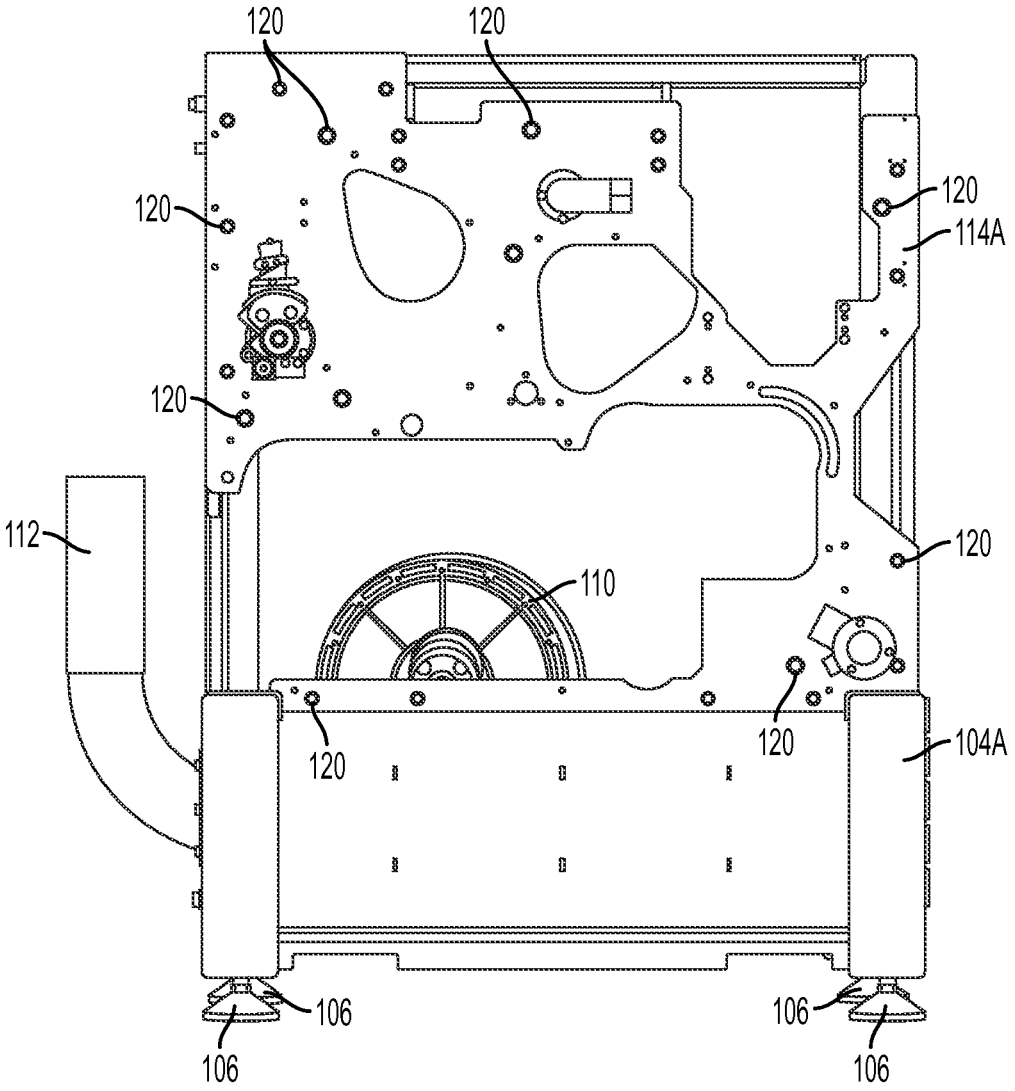
FIG. 4 is a front view of a base frame of the modular cigarette processing machine of FIG. 1, shown separately from the inspection component.

Referring to FIG. 3, the base frames 104A, 104B can each include a back support 114A, 114B that extends upright, e.g., substantially vertically. FIG. 3 shows the base frames 104A, 104B and corresponding back supports 114A, 114B with the function modules removed. As shown, the base frames 104A, 104B and constituent back plates 114A, 114B can be joined together, for example, by bolts, quarter turn screws, quick release clamps, or other mechanisms known in the art. Thus, as shown in FIG. 4, the base frame 104A can be used independently of the base frame 104B, and vice versa, allowing the cigarette processing machine 100 and cigarette inspection machine 102, and corresponding function modules, to be used independently of one another.

Referring to FIGS. 2 and 3, the base frames 104A, 104B can also house a central vacuum source 110, which can provide vacuum, as needed, to various function modules used with the machines 100, 102. According to embodiments, conduits extending through, or associated with the back plates 114A, 114B can direct vacuum to various function modules, for example, to provide vacuum to drum flutes and other devices that use vacuum force. According to embodiments, the central vacuum source 110 can include an exhaust connector 112 that can be used, for example, to connect the central vacuum source 110 to a factory's central dust collection system, or to a dust bag. A separate vacuum source can be used as an alternative, or in combination with the central vacuum source 110.

Before turning to description of the specific function modules, the back plates 114A, 114B will be described in more detail. Referring specifically to FIG. 3, the back plates 114A, 114B can include different areas configured to receive a variety of different function modules. In FIG. 3, the different areas are outlined in a combination of solid and dashed lines. For example, the back plate 114A for the processing machine 100 can include a hopper area A dimensioned to mount, for example, a variety of different hopper modules. The back plate 114A can also include an infeed area B dimensioned to mount, for example, a variety of different infeed modules. Further, the back plate 114 can include a drum area C, a gluing area D, and/or a knife area E dimensioned to mount, for example, a variety of drum modules, glue modules, and/or knife modules, respectively. Additional or different areas may be provided to accommodate additional or different modules, as may be needed to suit a particular application. The back plate 114B of the inspection machine 102 can include an inspection module area F and an automatic bobbin changeover unit area G dimensioned to mount, for example, a variety of inspection modules and/or changeover units.

Still referring to FIG. 3, the back plates 114A, 114B can each include a plurality of guide elements 120, also referred to as "quick connection points," which can aid in securing function modules to the back plates 114A, 114B. Different guide elements 120, and patterns of guide elements 120, can be located on the back plates 114A, 114B, for example, in connection with the different areas A, B, C, D, E, F, and G. The guide elements 120 can complement corresponding guide elements located on various function modules, as will be described in more detail below.

Referring back to FIG. 1, the machines 100, 102 are shown with a plurality of function modules installed. As shown, the cigarette processing machine 100 can include a filter hopper module 122 installed on the back plate 114A, for example, in the hopper area A. The filter hopper module 122 can store a supply of rod-shaped articles, such as cigarette filters, and dispense them for downstream processing, for example, via one or more hopper drums 124. Filter hopper module 122 shown in FIG. 1 can be configured to store and distribute single or multiple-length (e.g., 2, 4, 6, 12) filter rods. However, according to embodiments, filter hopper module 122 can be removed from the back plate 114A, and a different filter hopper module can be attached in its place. For example, different hopper modules configured to work with different sizes of rods, or different types of products (e.g., complete filter cigarettes) can be attached to the back plate 114A in place of the filter hopper module 122 shown. Alternatively, different hopper modules having different product capacities can be attached to the back plate 114A in place of the filter hopper module 122 shown.

Still referring to FIG. 1, the machine 100 can have an infeed module 126 (e.g., a tobacco rod infeed module) mounted to the back plate 114A, for example, in the infeed area B. The infeed module 126 can receive tobacco rods, e.g., from an external cigarette maker or other unit with feed drums, and feed them into the machine 102, for example, using feed drums 128. Additionally or alternatively, the infeed module 126 can space pairs of tobacco rods apart for subsequent insertion of a filter therebetween. The infeed module 126 can be removed from the back plate 114A, and a different module can be attached in its place. For example, different infeed modules configured to work with different sizes or types of tobacco rods can be attached to the back plate 114A in place of the infeed module 126 shown.

Still referring to FIG. 1, the machine 100 can also include a drum module 130, tipping knife module 132, and/or gluing module 134. These modules can be attached to the back plate 114A, for example, in the rolling area C, gluing area D, and knife area E, respectively. The drum module 130 can include, among other things, a plurality of drums 136 that transport the rod-shaped article (e.g., a cigarette or parts thereof), laterally across the machine. In the embodiment shown, the drums 136 are staggered with respect to one another (e.g., their axes of rotation are not aligned along a straight line). This staggered configuration can lead to considerable space savings lengthwise, for example, between 150 mm and 200 mm, however, other configurations, such as straight configurations, are possible.

Still referring to FIG. 1, the drums 136 can include, from right to left, a component assembly drum, a component alignment drum, a component rolling drum, a laser/transfer drum, a component cutting drum, and a transfer drum, however, other configurations are possible. Embodiments of the tipping knife module 132 can include, among other things, a rotating knife 140 and a suction drum 142. Embodiments of the gluing module 134 can include, among other things, gluing rollers 144.

According to embodiments, the drum module 130, tipping knife module 132, and gluing module 134 can cooperate to form a complete filter cigarette or other single-part or multi-part rod-shaped product. According to a multi-part embodiment, a double-length filter stored in the filter hopper module 122 can be joined in end-to-end fashion with a pair of tobacco rods fed by the infeed module 126 to form a "double-ended" filter cigarette. More specifically, the gluing module 134 can apply adhesive to a tipping paper, which can be cut to size, for example, by the tipping knife module 132, and wrapped around the double-length filter rod and adjoining tobacco rods to form the double-ended filter cigarette. The double-ended cigarette can be fed by the drum module 130 in the direction of the left-hand side of FIG. 1. According to embodiments, the drum module 130 can cut the double-ended filter cigarette in half, resulting in a pair of individual filter cigarettes. Alternatively, single length filter segments can be processed.

According to embodiments, each of the drum module 130, tipping knife module 132, and gluing module 134 can be removed from the back plate 114A and replaced, interchangeably, with another module which may be, for example, configured for different types or sizes of cigarettes.

Still referring to FIG. 1, the cigarette inspecting machine 102 can include an inspection module 150 as well as an auto bobbin changeover module 152. These modules can be attached to the back plate 114B, for example, in inspection module area F and a bobbing changeover module area G, respectively. The inspection module 150 can inspect filter cigarettes (e.g., received from the drum module 130) for various attributes indicative of an acceptable product. For example, the inspection module 150 can test the filter cigarettes for leakage, excessive pressure drop across the cigarette, presence or absence of filter, improper location of the tipping paper, and presence of loose tobacco strands (e.g., extending out of the end of the tobacco rod). One of ordinary skill in the art will understand based on this disclosure that the inspection module can alternatively check for different attributes of the cigarette. As shown in FIG. 1, a turning drum 153 can rotate every other cigarette about 180 degrees as it goes from the drum module 130 to the inspection module 150, so that all cigarettes have the same orientation, however, other sequences of operation are possible.

According to embodiments, the cigarette inspection machine 102 can be used as a stand-alone machine, e.g., independently of the machine 100. According to these embodiments, the inspection module 150 can be used to inspect complete cigarettes made in an independent, upstream process.

The auto bobbin changeover nodule 152 can include, among other things, a turntable 154, bobbin 156, automatic splicer 158, and can be used, for example, to automatically replenish and splice the tipping paper used in the tipping module 132. This may allow for continuous operation and avoid the need to shut down the machine when the tipping paper is depleted. In embodiments where the auto bobbin module 152 is not used, the tipping paper can alternatively be supported on the back plate 114A and changed over manually or by some external means.

Tipping paper may be used to overwrap a label to mask cigarettes. According to embodiments, the inspection module 150 and/or auto bobbin changeover module 152 can be removed from the back plate 114B and replaced, interchangeably, with another module that may be configured for different types or sizes of cigarettes.

Further, as stated previously, the testing machine 102 can be separated from the cigarette processing machine 100, and both can be used as independent, stand-alone machines.

As discussed above, each of the modules 122, 126, 130, 132, 134 on the processing machine 100, as well as the modules 150, 152 on the inspection machine 102, can comprise "plug-and-play" units. For example, each module can serve as a substantially self-sufficient unit that performs a manufacturing operation, e.g., a subset of the cigarette manufacturing process, such as, but not limited to, rolling, cutting, joining, tipping, or inspecting. According to embodiments, this means that the respective modules can be removed from the back plate 104A, 104B, and replaced, as a functional unit and without significant assembly or disassembly. For example, according to embodiments, the modules can be removed and replaced as a unit, without any additional assembly or disassembly except for, e.g., connecting or disconnecting wires, vacuum hoses, or the like. According to embodiments, this means that each module has its own mounting plate that supports the module in its entirety, and facilitates mounting of the module to the back plate, for example, in its respective mounting area.

Additionally or alternatively, this means that each module includes a dedicated drive motor or other source of propulsion that allows the module to operate without requiring connection to an external drive source. According to embodiments, each module can include a single plug (such as a wire harness) that makes all electrical and electronic connections for the module. Likewise, a single connection point, such as a quick disconnect, can make all pneumatic connections for the module. According to embodiments, the electrical and pneumatic connections can be incorporated into one plug, or alternatively, they can be separate.

Figure 6:
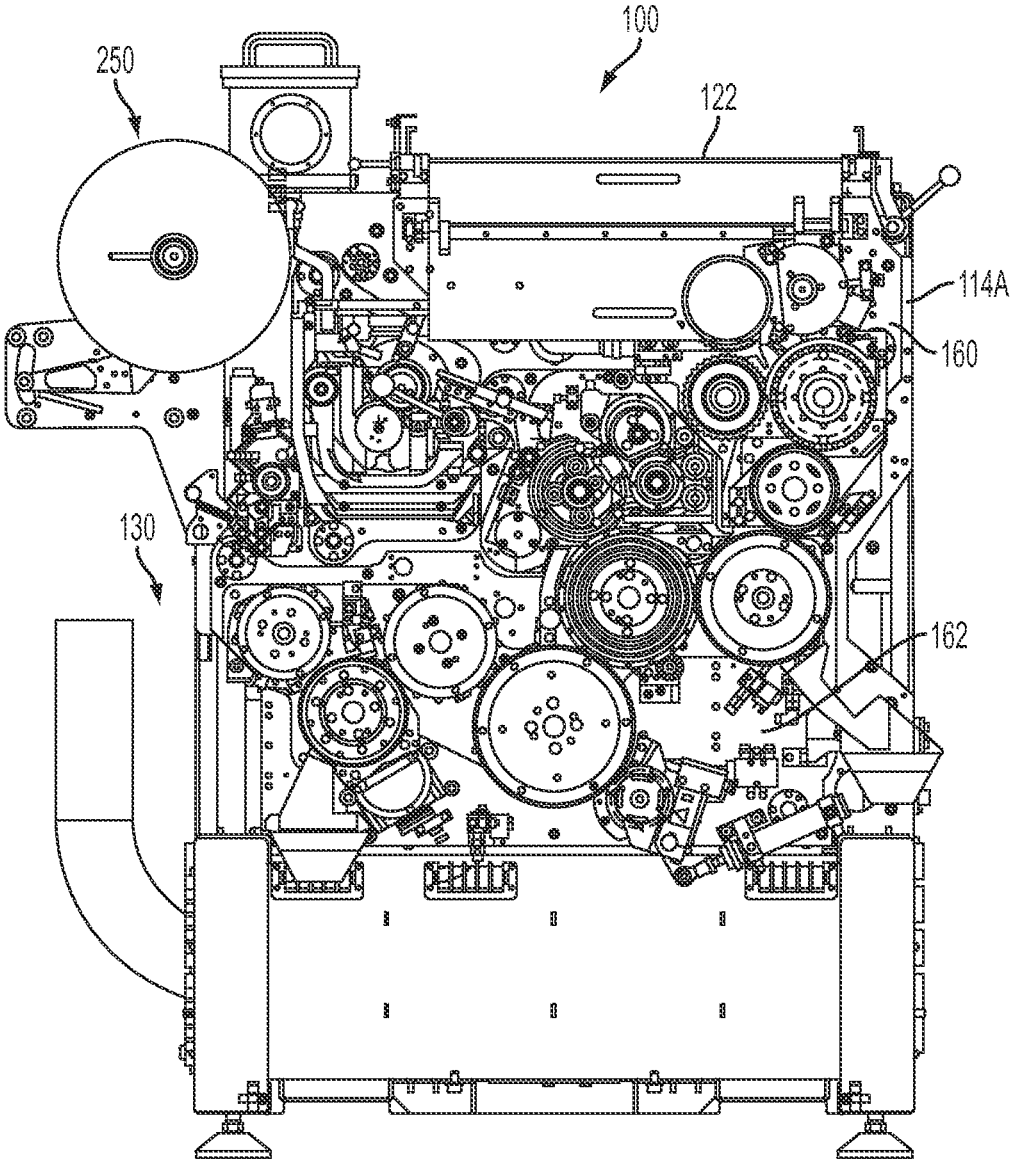
FIG. 6 is a front view of the modular cigarette processing machine of FIG. 1, shown without the inspection component, and in a different configuration.
Figure 7:
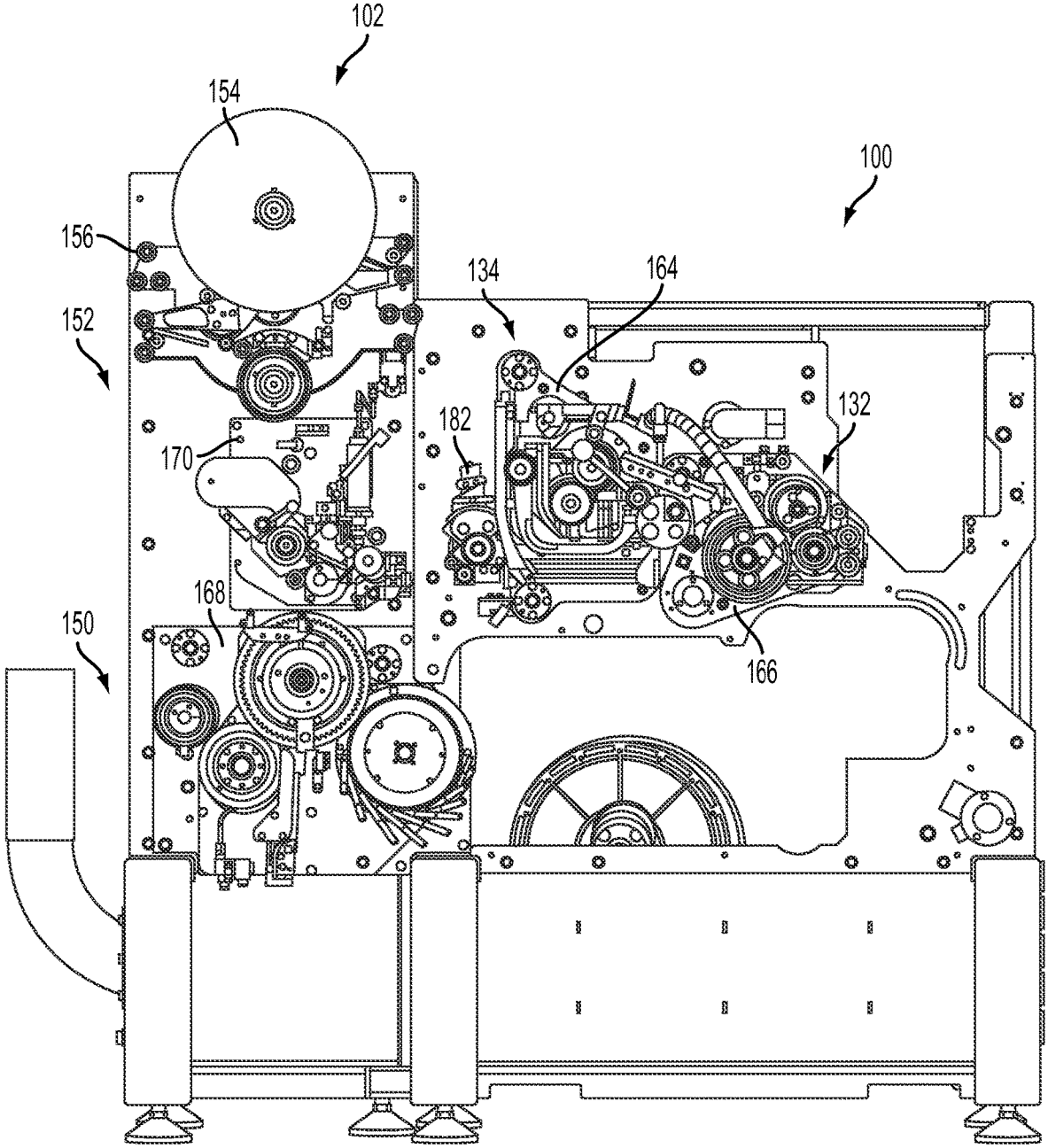
FIG. 7 is a front view of the cigarette processing and inspection machine of FIG. 1, shown with a different configuration of function modules.

Referring to FIG. 6, the mounting plate 160 for the filter hopper module 122 can be seen, as can the mounting plate 162 for the drum module 130. Referring to FIG. 7, the mounting plates 164, 166 for the gluing module 134 and tipping module 132, respectively, can be seen. The mounting plates 168, 170 for the inspection module 150 and auto bobbin changeover module 152 can also be seen. It is contemplated that in some embodiments, portions of the auto bobbin changeover module 152, such as the turntable 154 and bobbin 156, will be located on their own mounting plates, and thus, embodiments can include modules sharing more than one mounting plate.

According to embodiments, each mounting plate can be substantially flat, and can define an outer perimeter that is generally coextensive with, or smaller than, the perimeter of the corresponding area A to E on back plate 114A or area F, G on back plate 114B. This allows the mounting plate to rest against the back plate 114A, 114B in the appropriate area, and not interfere with adjacent modules.

As discussed above, the back plates 114A, 114B can include guide elements 120. Each of the mounting plates can also include guide elements (not visible in the figures) that align with corresponding guide elements 120 on the back plates 114A, 114B, to easily align the modules in the appropriate area on the back plate 114A or 114B. For example, the guide elements can comprise recesses in the back plates 114A, 114B and mating pins (e.g., self centering pins) on the mounting plates. Alternatively, the guide elements can comprise cooperating pairs of magnets. According to yet another alternative, the guide elements can comprise threaded holes and corresponding bolts. According to embodiments, fasteners can be used in addition to the guide elements to secure the modules to the back plate (e.g., bolts, quarter-turn screws, clamps, etc.) or alternatively, the guide elements themselves can serve as the fasteners.

According to embodiments, each module can include its own, dedicated drive motor (e.g., an AC motor with variable frequency drive, linear drive). The dedicate drive motor can be coupled to the respective mounting plate, and can turn a portion of the module. For example, the dedicated drive can rotate one or more drums or rollers through a belt drive system. Additionally or alternatively, the dedicated drive can move a knife or similar cutting component. By including a dedicated drive as a component of the modules, each module can be removed in a "plug-and-play" fashion, taking the drive motor with it, removing the need to mechanically re-adjust the module when it is reattached to the machine, or to a different machine. This can also make the machine substantially immediately available for use after changing the module(s), reducing downtime.

Referring to FIG. 2, some examples of dedicated drives are shown protruding through the back of mounting plates 114A, 114B. For example, drive 170 is the dedicated drive for the filter hopper module 122, and is connected thereto via a belt and pulley mechanism, which is supported on the hopper module's mounting plate.

Drive 172 is the dedicated drive for the tipping knife module 132, and likewise operates via a belt and pulley mechanism located on the tipping knife module's mounting plate. Drive 174 is the dedicated drive for the gluing module 134, and drive 176 is the dedicated drive for the drum module 130. Drive 176 can operate via a belt and pulley mechanism mounted on the mounting plate for the drum module 130. Still referring to FIG. 2, drive 178 is the dedicated drive for the tobacco rod infeed module, drive 180 is the dedicated drive for the inspection module 150, and drive 182 is the dedicated drive for the auto bobbin changeover module 152.

Figure 5:
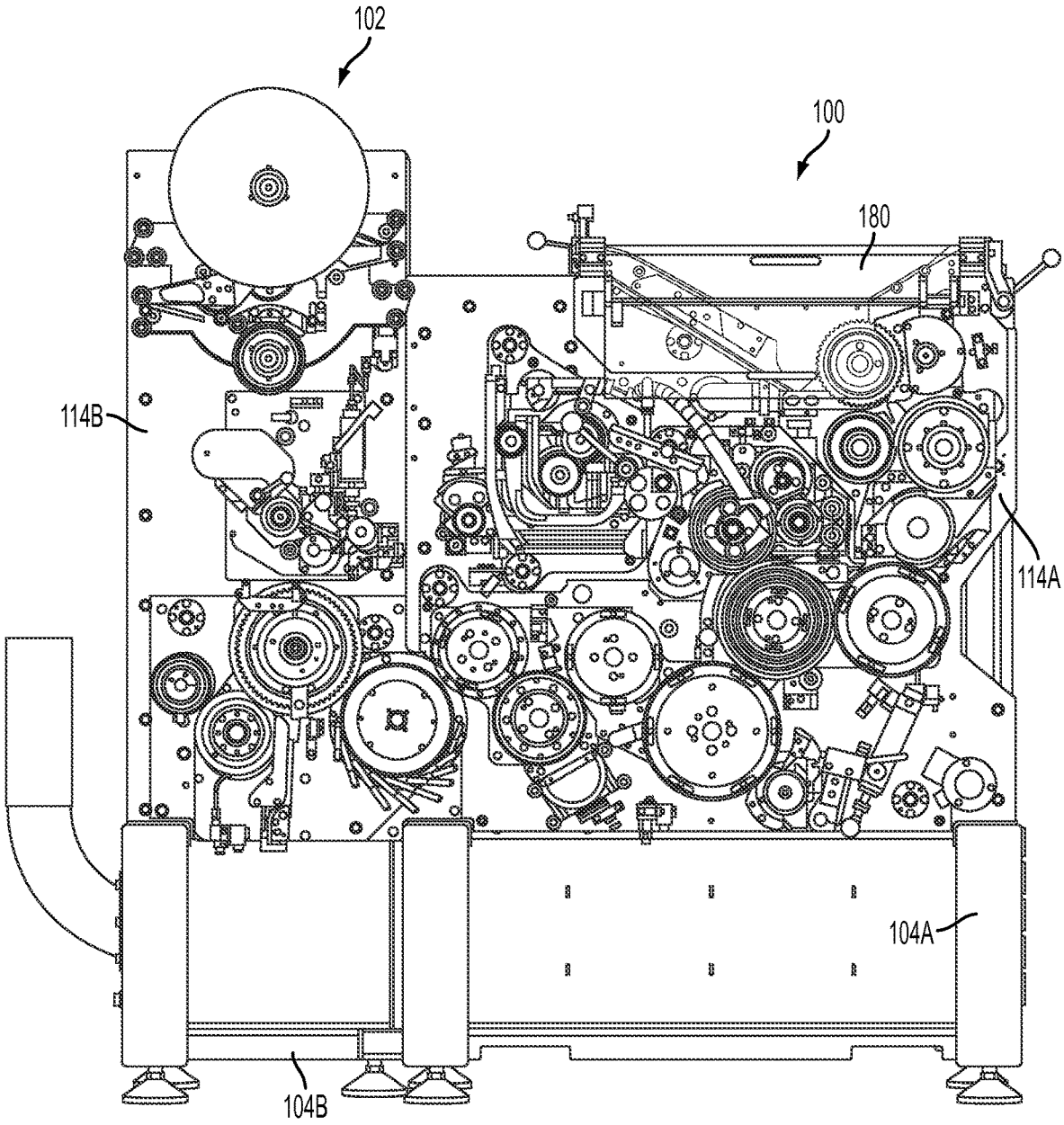
FIG. 5 is a front view of the modular cigarette processing and inspection machine of FIG. 1, shown in an alternative configuration.

Referring to FIG. 5, an alternative configuration of the machines 100, 102 is shown. According to this configuration, the tobacco rod infeed module 126 has been removed, and the filter hopper module 122 has been replaced with a filter cigarette hopper module 180, which is adapted to store completed filter cigarettes. According to this embodiment, completed filter cigarettes can be placed in the filter cigarette hopper 180 to mask the logo on existing cigarettes. One of ordinary skill in the art will appreciate from this disclosure, that not all modules need to be used at one time, but rather, the machines 100, 102 can be configured to use only the necessary modules required for a specific product format or operation. Thus, groups and subgroups of the function modules can be used interchangeably.

Referring to FIG. 7, a tipping paper metering roller 182 can be mounted directly to the back plate 114A, for example, adjacent to the gluing module 134. As shown in FIG. 7, the auto bobbin changeover module 152 can supply tipping paper to the tipping module 132. The tipping paper metering roller 182 can meter the tipping paper (e.g., control the rate of it) as it is supplied to the tipping module 132, however, other configurations are possible. As mentioned, the metering roller 182 can be mounted directly to the back plate 114A, e.g., without intervening mounting plate, however, alternative embodiments can be modular and include a dedicated drive motor.

Figure 8:
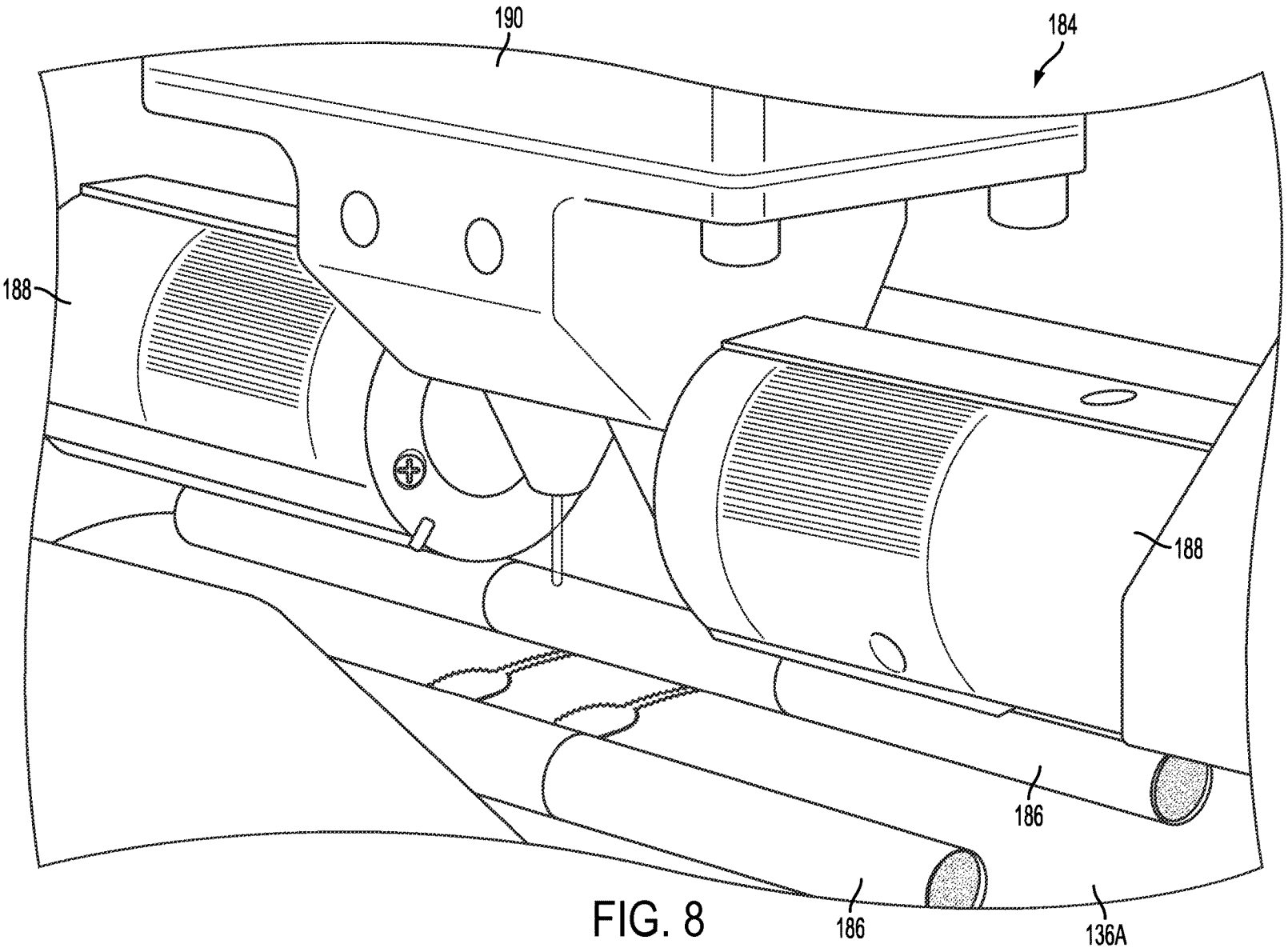
FIG. 8 is a perspective view of an embodiment of a laser perforator for use with the cigarette processing and inspection machine of FIG. 1.

Referring to FIG. 8, an embodiment of a laser perforating device 184 is shown. The device 184 can be used to perforate the cigarette paper and/or filter, for example, to adjust the air/smoke ratio of the cigarette. Embodiments of the laser perforating device 184 can be incorporated into the drum module 130. For example, one of the drums 136 of the drum module 130 can comprise a laser drum 136A, adapted to support a filter cigarette 186 about its periphery, for example, under the force of vacuum from central vacuum source 110. A rolling cam 188 can be located adjacent the periphery of the laser drum 136A, and can engage and roll the filter cigarette 186 about the periphery of the laser drum 136A at preselected times. A laser 190 can also be located adjacent to laser drum 136A, for example, on the mounting plate 162, and can burn perforations into the cigarette paper as the cigarette is rolled underneath laser 190 by the rolling cam 188. The operation of the laser 190 (e.g., frequency and/or duration of the laser) can be adjusted to provide the desired size and amount (e.g., 4, 8, or 12 holes) of the perforations, as will be understood by one of ordinary skill in the art based on this disclosure. Referring back to FIG. 2, a resonator 108 can provide the laser beam for the laser 190, however the present application is not limited to the embodiment shown. Although FIG. 8 shows a split rolling cam 188, alternative embodiments are possible.

Referring back to FIG. 6, a configuration of the cigarette processing machine 100 without the cigarette inspection machine 102 is shown. In some embodiments, the cigarette processing machine 100 can be used to perform a variety of processes, for example, forming filter cigarettes. In the embodiment shown, the machine 100 can be used to perforate a portion of a pre-formed tobacco rod and/or filter, for example, using the laser perforating device 184 described above, however other uses are possible. FIG. 6 depicts the machine 100 with a single bobbin 250 mounted to the back plate 114A. According to embodiments, the single bobbin 250 can comprise a function module mounted to the back plate 114A in a similar manner to the other modules described herein.

It may be necessary from time to time to calibrate, recalibrate, or adjust settings for the machine (or individual function modules) for different products or operations. For example, embodiments with an inspection component may need to be calibrated, for example, to set the sensors using a test rod. As another example, machine settings may need to be adjusted to correctly position machine elements with respect to one another, such as cooperating drums. To reduce the amount of down time associated with the calibration and machine setting processes, the present application encompasses a system for adjusting and storing various settings of the function modules. For example, once two or more modules are calibrated for a specific product format or process, or have their settings set with respect to one another (e.g., have their drums, knives, or other components aligned and/or synchronized with one another), the settings of those modules can be stored in the memory of a central control system, such as a programmable logic controller or computer. In the event the settings of the machine are changed (e.g., to accommodate a different process, product format, or set of function modules) and later need to be changed back to the prior settings, the need to re-do the calibration or machine setting process can be shortcut, or eliminated, by recalling the proper settings from the memory.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings.

It is therefore to be understood that, within the scope of the claims and their equivalents, the invention may be practiced otherwise than as specifically described.

The invention claimed is:

1. A processing machine for rod-shaped articles, comprising:

a base frame;

a back plate attached to and extending upward from the base frame;

a plurality of function modules mounted to the back plate, each of the plurality of function modules being configured to perform a manufacturing function on a rod-shaped article, each of the plurality of function modules including:

a mounting plate adapted to removably attach each corresponding function module to the back plate as a unit, a dedicated drive motor supported on the mounting plate, the dedicated drive motor being configured to move at least a portion of the corresponding function module, and a connection on the mounting plate, wherein the connection is configured to provide a connection point for at least one of electrical connections or pneumatic connections; and a control system comprising a memory configured to store a calibration setting of each of the plurality of function modules and a computer configured to recall the calibration setting of each of the plurality of function modules;

wherein the dedicated drive motor of each of the plurality of function modules is distinct from another dedicated drive motor of another one of the plurality of function modules;

wherein the control system is configured to store the calibration setting of each of the plurality of function modules in the memory, to recall the calibration setting by the computer, and to adjust one or more of the plurality of function modules to the recalled calibration setting after a setting of the one or more of the plurality of function modules is changed, and wherein the control system is configured to adjust one or more settings of the processing machine to position or synchronize the plurality of function modules with respect to one another, or both.

2. The processing machine of claim 1, wherein the plurality of function modules includes a rod infeed module, a hopper module, a drum module, a knife module, and a gluing module.

3. The processing machine of claim 1, further comprising:

an inspection module including a mounting plate adapted to attach the inspection module to the back plate as a unit, the inspection module adapted to inspect the rod-shaped article for at least one of leakage, pressure loss, paper location, and presence of loose strands.

4. The processing machine of claim 3, wherein the inspection module further includes a dedicated drive motor adapted to rotate at least one drum of the inspection module.

5. The processing machine of claim 1, further comprising an auto bobbin changeover module including a mounting plate adapted to attach the auto bobbin changeover module to the back plate as a unit.

6. The processing machine of claim 5, wherein the auto bobbin changeover module further includes a dedicated drive motor adapted to rotate at least one drum of the auto bobbin changeover module.

7. The processing machine of claim 1, wherein the back plate includes a hopper module location to which a hopper module mounting plate removably attaches.

8. The processing machine of claim 1, further comprising:

a vacuum source mounted to the base frame; and one or more conduits adapted to connect the vacuum source to one or more of the plurality of function modules.

9. The processing machine of claim 2, further comprising a tipping paper metering roller secured directly to the back plate.

10. The processing machine of claim 2, wherein the drum module comprises a laser and a laser rolling drum opposed to the laser, wherein the laser is adapted to create holes in the rod-shaped articles located on the laser rolling drum.

11. The processing machine of claim 1, wherein each of the plurality of function modules includes first guide elements located on the corresponding mounting plate, and the back plate comprises second guide elements adapted to engage the first guide elements to attach each of the plurality of function modules to the back plate respectively.

12. The processing machine of claim 2, wherein the dedicated drive motor is adapted to turn at least one drum of the drum module.

13. The processing machine of claim 2, wherein the dedicated drive motor is adapted to move at least one knife of the knife module.

14. The processing machine of claim 2, wherein the rod infeed module, the hopper module, the drum module, the knife module, and the gluing module are configured to be removed from the back plate and replaced, interchangeably, with another module.

* * * * *